United States Patent [19]

Loveland

[11] 4,004,401

[45] Jan. 25, 1977

[54] AUTOMATIC CARTON CLOSING MACHINE SIDE GUIDE RAILS HOLDING MECHANISM PROVIDING CLEARANCE FOR ALL CARTONS OF ONE ALLEGED SIZE WITH ACCOMMODATION OF SMALL DEGREES OF VARIANCES

[75] Inventor: Winton Loveland, Fort Salonga, N.Y.

[73] Assignee: The Loveshaw Corporation, Deer Park, N.Y.

[22] Filed: Mar. 29, 1976

[21] Appl. No.: 671,286

[52] U.S. Cl. ..... 53/374; 198/456

[51] Int. Cl.² ..... B65B 7/20

[58] Field of Search ..... 53/374, 375; 198/29

[56] References Cited

UNITED STATES PATENTS

| | | | |
|---|---|---|---|
| 3,085,376 | 4/1963 | Ferguson et al. | 53/374 X |
| 3,708,951 | 1/1973 | Folk et al. | 53/374 X |

*Primary Examiner*—Travis S. McGehee
*Attorney, Agent, or Firm*—Watson, Leavenworth, Kelton & Taggart

[57] ABSTRACT

In an automatic carton closing machine, adjustable holding mechanism for a pair of elongated longitudinal clamping rails which converts them to laterally spaced side guide rails extending through the machine to define a path of carton forward travel therebetween and provides sliding clearance for all loaded cartons of a group intended to be of about the same size while accommodating small degrees of variances in widths thereof. For this purpose there are provided means to move at least one of the pair of side guide rails inward toward the other to cause them to be spaced apart with location thereof closely adjacent to opposite sides of a loaded carton of a single size group as it enters the machine for forward guided transport therebetween past flaps manipulating and anchoring mechanisms of the machine, and means to adjust such spacing between these rails to assure attainment of the desired relatively small degree of additive tolerance.

10 Claims, 5 Drawing Figures

AUTOMATIC CARTON CLOSING MACHINE SIDE GUIDE RAILS HOLDING MECHANISM PROVIDING CLEARANCE FOR ALL CARTONS OF ONE ALLEGED SIZE WITH ACCOMMODATION OF SMALL DEGREES OF VARIANCES

BACKGROUND AND SUMMARY

The present invention is concerned with the mechanism for manipulating transversely elongated longitudinal clamping rails in automatic carton closing machines for adjusting the intervening space therebetween to convert them to suitably spaced lateral side guide rails extending longitudinally through the machine to define a path of forward travel of a plurality of successive cartons. It is particularly concerned with the satisfaction of a desire to space them transversely with a tolerance which will permit free advance, without damage, of all of a group of set-up cartons, which may be loaded for shipping contents, and intended to be of about the same size while accommodating small degrees of variances in widths thereof and to accomplish this by relatively simple equipment that is easily added to conventional equipment for manipulating the side guide rails of automatic carton closing machines of the types disclosed in U.S. Pats. No. Re. 26,440 of Aug. 13, 1968 (and its parent U.S. Pat. No. 3,236,022); U.S. Pat. No. 3,382,645 of May 14, 1968; and U.S. Pat. No. 3,496,697 of Feb. 24, 1970. Disclosures of those patents which are pertinent to the present invention are embodied herein by reference. In order to accomplish this end automatic control mechanism will be set to cause widely spread side guide rails to respond to a dictated command to move transversely inward toward opposite sides of an entering first loaded carton of such a group of intended same size and then to be separated transversely back through the desired relatively small additional space of tolerance. Following the teaching of the present invention a variety of types of means may occur to one which might be substituted for a preferred means to adjust the width of the transverse space between the opposed longitudinal side guide rails when first set to process successively therebetween a series of assumed similar width loaded cartons of a group intended to be of the same size and then provide a moderate tolerance between these guide rails that will avoid damaging or jamming of any of these cartons, that may be slightly wider due to overfilling or other cause, as these cartons are moved successively forward therebetween.

The first carton of the group of similar size to be advanced through the machine may serve as a gauge for the primary adjustment of the spacing between these side guide rails and then various types of differing devices may serve to assure the attainment of the small amount of the desired supplementary spacing tolerance. For example, the mechanisms which move these guide rails inward and outward relative to each other may be connected to the latter by resilient means which provides the desired tolerance. A longitudinally extending facing shoe may be mounted to the face of one of these guide rails, or both may be so equipped, and resilient means between the rail face and such facing shoe may provide the requisite tolerance, particularly if the entrance ends of these facing shoes are flared outwardly to define a feeding tapered space therebetween. Also, the guide rails moving mechanism may impose the transverse movement thereto through camming devices wherein relatively high lobe means dictate initial or primary relative rail spacing and then relatively low cam lobe means attain the secondary or additional tolerance spacing. However, the preferred mechanism for such a spacing tolerance service is that which is detailed herein as pertaining to a latching device associated with the side guide rails transverse driving mechanism, with this latching device being biased by alterable or change means to effect the needed repositioning of the latch or the change in the holding action.

It is thus an object of the present invention to attain such relatively minor tolerance spacing of the side guide rails by embodying in their transverse moving equipment means that moves in proportion to the degree of motion of such equipment for attaining the basic spacing of the side guide rails for such a size of loaded cartons, and means which then further spaces them apart the desired relatively small additive tolerance distance.

More specifically, it is an object of the present invention to embody in the side guide rails transverse moving equipment a toothed rack or pinion means which moves in proportion to the degree of motion of this equipment, and associate therewith a floatably mounted means to engage such rack or pinion so that the motion freedom that this latter means has determines and allows the relatively minor amount of tolerance adjustment desired.

A preferred form of the equipment to effect the basic spacing of the side guide rails includes a double-ended pneumatic motive cylinder having its piston connected by flexible pull tether means, e.g., cable or linked chain, to the side guide rails. Valving of pressurized gaseous medium, such as air, in the supply ducts connected to the cylinder permits the latter and its piston to act as an elastic cushioning means, so that additional driving force applied to such tether means may translate the latter a limited additional amount, to provide the desired additional spacing tolerance. Such additional driving force may be applied by suitable rack or gear means that moves with the tether means and is engageable by latch means to apply therethrough the desired additional translation of this tether means. Desirably gear means may be rotated by longitudinal translation of the tether means, and vice versa, so that after the primary rail spacing is attained by drive of the tether means from the double-ended cylinder, the secondary tolerance spacing may be added by rotating the gear means through a radial angle by engaging it with the latch means as a driver and swinging the latter.

In accordance with the present invention it has been found that a practical and preferred means for effecting such swing of the gear means driver may be in the form of a pair of single-ended pneumatic motive cylinders with the front end of one pivoted on the axis of the gear means and its projecting piston rod carrying the latch means to engage this gear means for the relatively small angular drive of the latter. In turn, the latch means is swung by arcuate swing of this motive cylinder and, for this purpose, the back end of the latter may be pivotally connected to the projecting piston of the other of this pair of single-ended cylinders with the latter having its back end pivotally mounted to a fixed position support.

Other objects of the invention will in part be obvious and will in part appear from reference to the following detailed description taken in connection with the accompanying drawings, wherein like numerals identify similar parts throughout, and in which.

Figure 1:
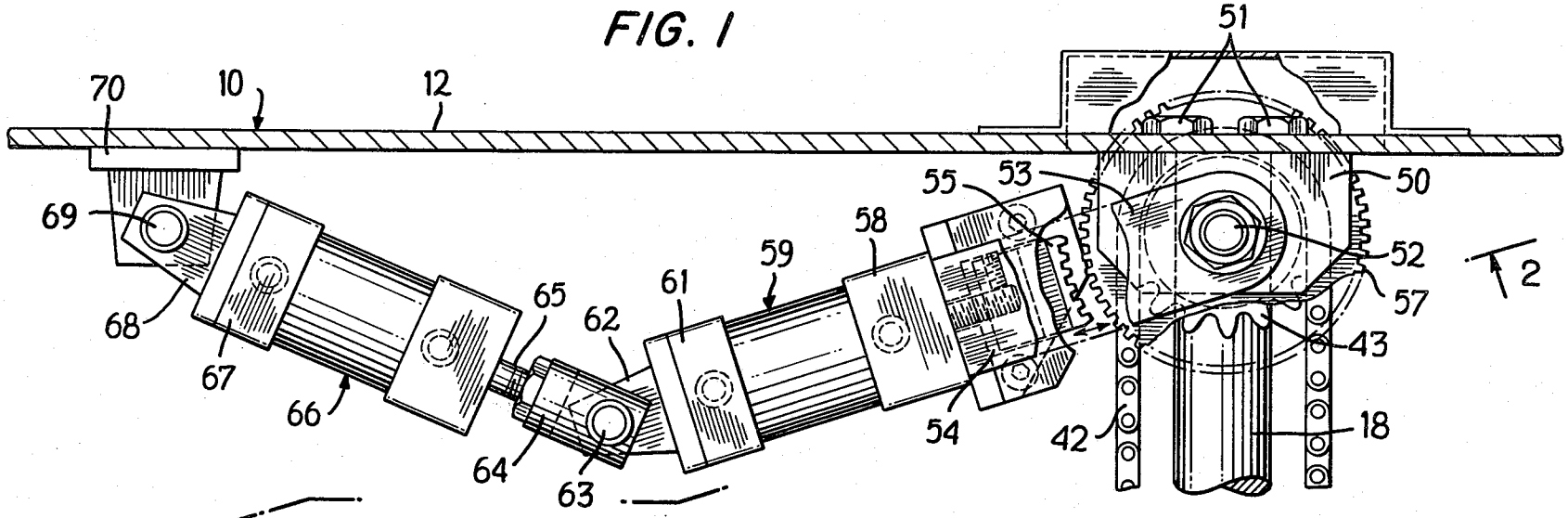
FIG. 1 is a plan view, with parts broken away and in section, of a preferred form of the mechanism to provide the desired tolerance in the spacing of the pair of side guide rails.
Figure 2:
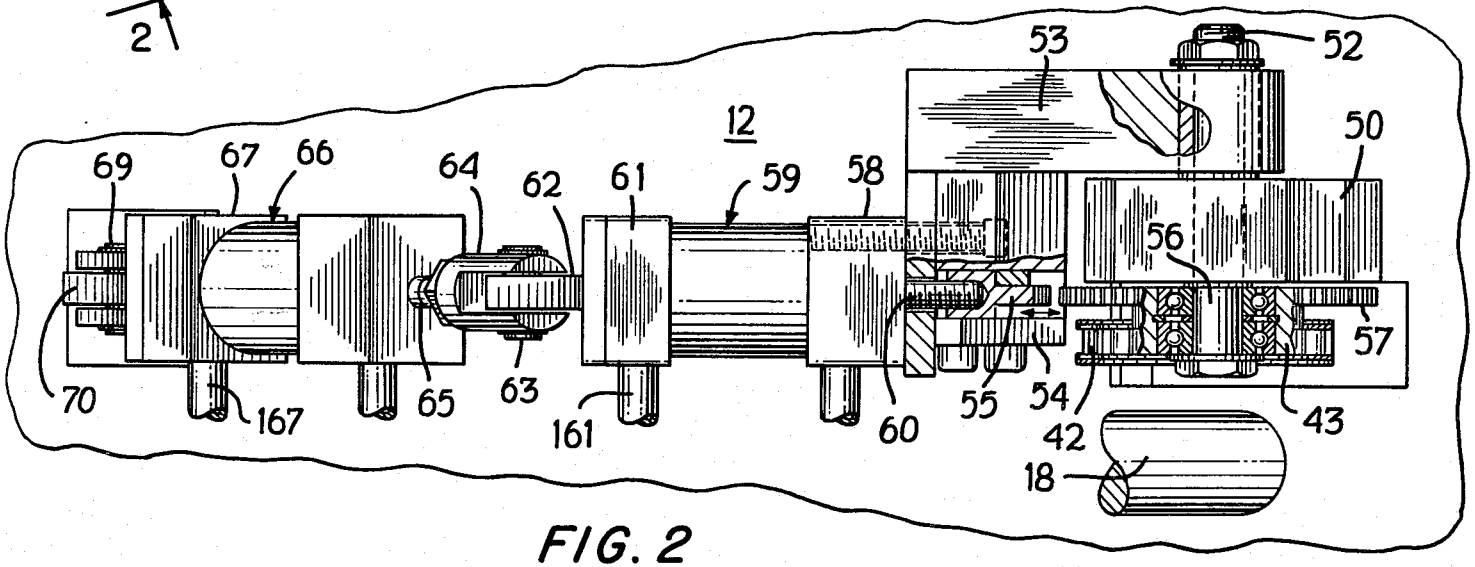
FIG. 2 is a view taken substantially on line 2—2 of FIG. 1, with parts broken away and in section, of the structure shown in FIG. 1.
Figure 3:
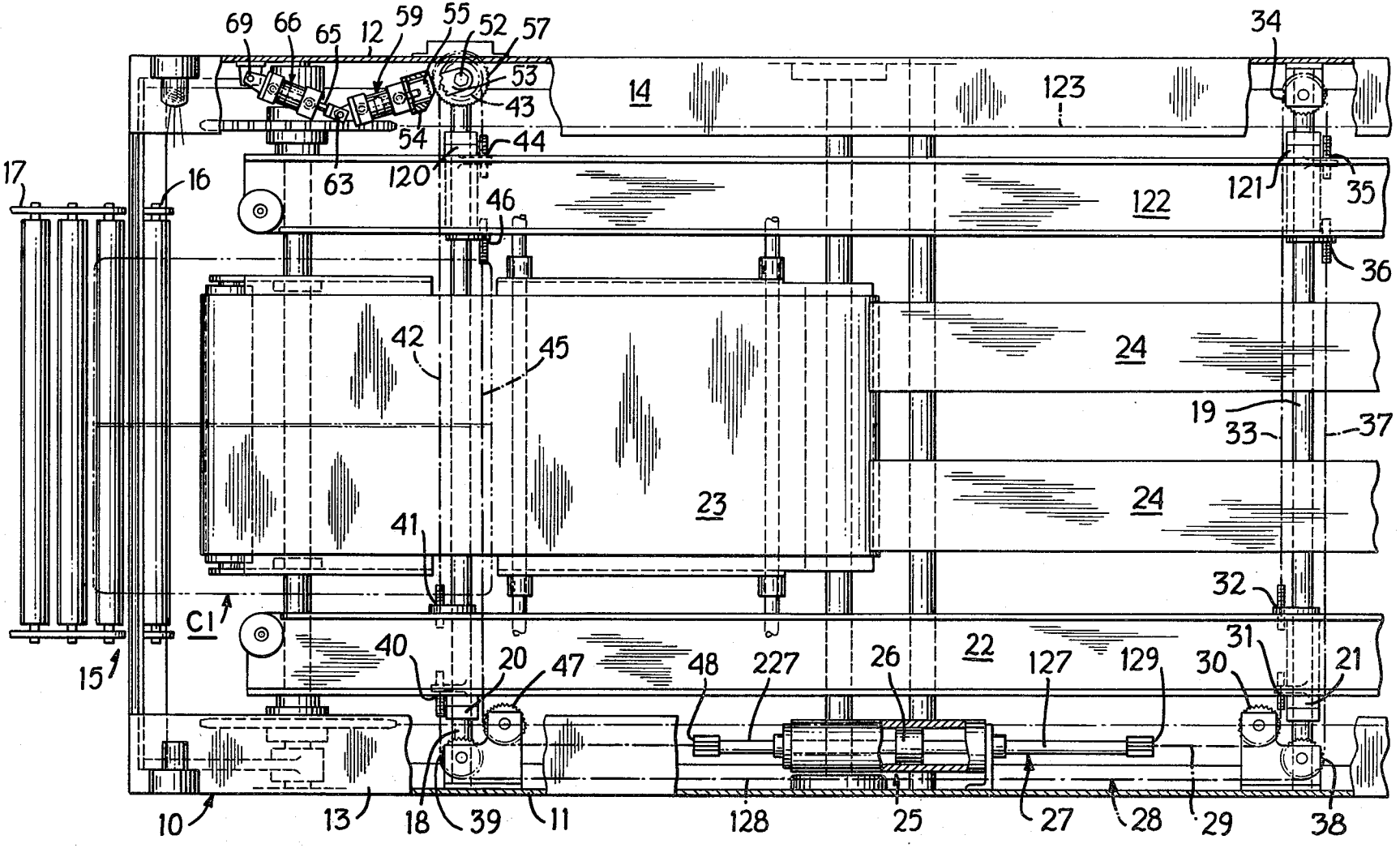
Figures 4, 5:
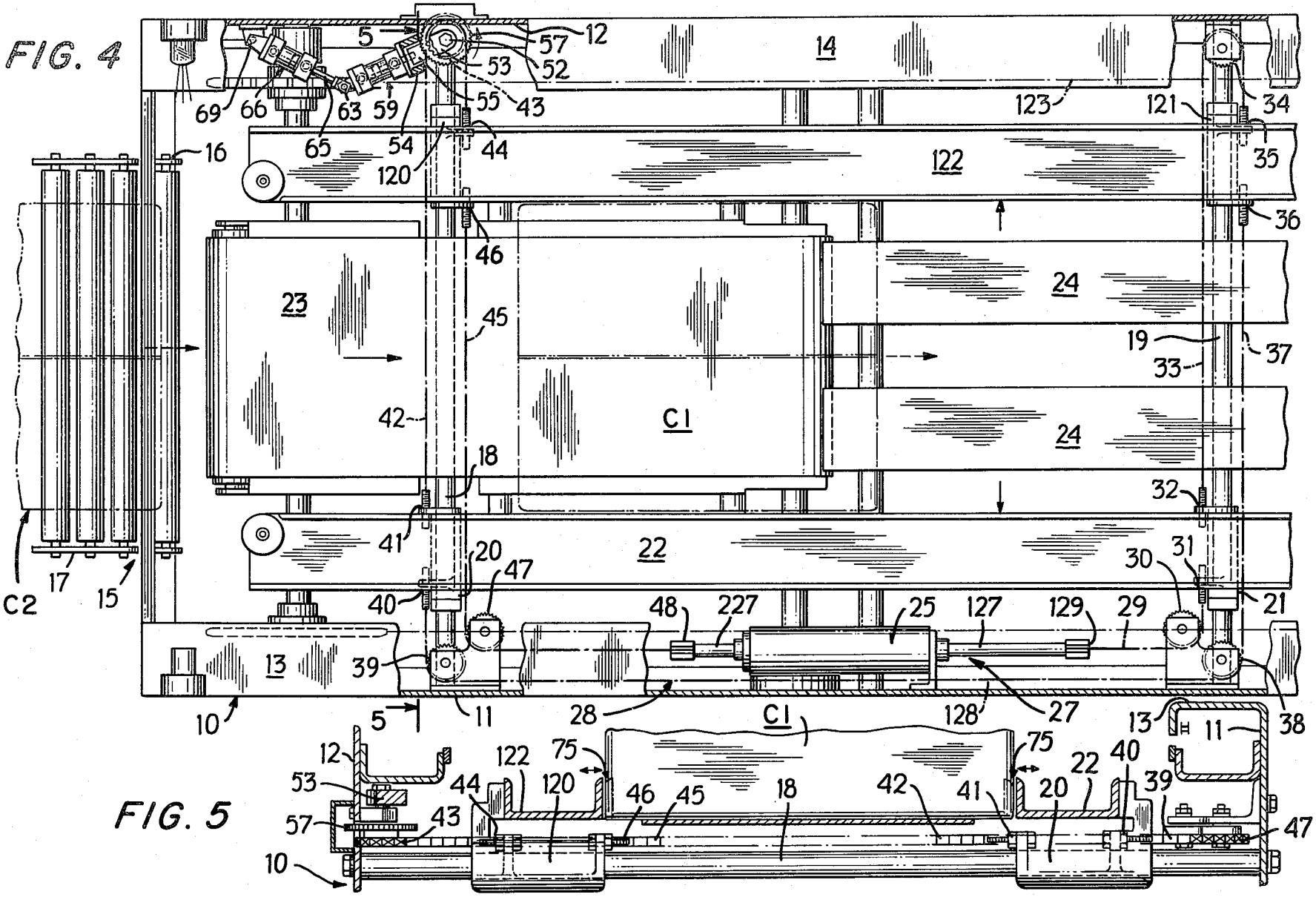

FIG. 3 is a plan view to smaller scale, with parts broken away and in section, of the entrance end of an automatic carton closing machine equipped with mechanism to move the pair of transversely spaced side clamping rails and as converted to side guide rails, with the addition thereto of the equipment of FIGS. 1 and 2 including the same relative positions of parts of the latter in the non-engaging position, and illustrating in broken lines entry of a carton;

FIG. 4 is a view similar to FIG. 3 showing in broken lines the outline of the sidewalls of the exemplary carton located between the transversely spaced side guide rails with tolerance clearance as attained by the operation of the equipment of FIGS. 1 and 2 in the latching position of the latter; and FIG. 5 is a transverse sectional view taken substantially on line 5—5 of FIG. 4, and to larger scale to illustrate more clearly the tolerance clearance attained.

FIGS. 3, 4 and 5 illustrate approximately the front half of a typical automatic carton closing machine bed unit 10 in which is embodied, by way of example, the pair of transversely-spaced, longitudinally-extending, lateral clamping side rails which are convertible to side guide rails, for successive advance forward between the latter of loaded cartons for manipulative folding of side and end flaps and carton-closing anchorages thereof. This bed unit 10 is in the form of a frame structure having opposed sidewalls 11 and 12 which, together with their top lateral flanges 13 and 14 support various equipment and mechanisms of the machine. The entrance end 15 of this bed frame structure 10 is equipped with a suitable lowerable and liftable entrance gate 16 which is manipulated to permit successive entry of loaded cartons from a suitable feeding conveyor 17. When the group of successive loaded cartons on the feeding conveyor 17 are of a particular size to be successively processed through the automatic carton closing machine these are aligned suitably by any desired means upon such feeding conveyor so that their longitudinal center lines will be aligned with the longitudinal center line of this machine bed frame structure.

Transverse frame rods, such as the pair shown at 18 and 19, are supported by the frame structure sidewalls 11 and 12, and, as may be best understood from FIGS. 4 and 5, slidably support pairs of slides 20 and 120, and 21 and 121, which support the longitudinally-extending pair of side guide rails 22 and 122 which are to be moved transversely toward and away from each other for receiving therebetween successive loaded cartons from the supply on the feeding conveyor 17.

It will be noted from FIG. 3 that the leading loaded carton $C_1$ on the feeding conveyor 17 has been carefully centered for entrance over the lowered entrance gate 16 onto the initial driven conveyor section 23, in the form of a driven endless belt, and between the opposed inner sides of the transversely separated side guide rails 22 and 122. The spacing between these side guide rails is adjusted for receiving therebetween with slidable ease the first carton $C_1$ of the group of loaded cartons for advance by endless belt conveyor 23 to the longitudinal carton support plates or rails 24 which normally terminate in the vicinity of the discharge end of the machine bed frame structure, and forward transport along the latter is accomplished in conventional manner by an endless chain conveyor 123 having carton-advancing cross flights (not shown).

In order that the side guide rails 22 and 122 may be suitably transversely spaced apart for receiving therebetween the first loaded carton $C_1$ of the group of intended same size a double-action type of pneumatic cylinder 25 having its piston head 26 equipped with a through piston rod 27, having opposite projecting ends 127 and 227, is suitably connected to a continuous loop of flexible cable or chain, or equivalent, and collectively referenced 28. When the piston rod end 127 is retracted it applies pull to a length 29 of tether cable or chain, connected thereto at 129, and lapped about free-running sprocket 30 to anchorage at 31 with side guide rail 22, the latter also having anchored thereto at 32 another piece 33 of flexible tether lapped about another sprocket free-running 34 on the far side of the bed structure to anchorage of the other side guide rail 122 at 35. There is also anchored to side guide rail 122, at 36 another length 37 of the flexible tether which is lapped about sprocket 38 for continuing longitudinally as the run 128 thereof for lapping about sprocket 39 up to anchorage 40 with the side guide rail 22. The latter also has anchored thereto at 41 an additional run 42 of the flexible tether which extends to the opposite side of the bed frame structure for lap about sprocket 43 down to anchorage 44 at the side guide rail 122. The last run 45 of the endless flexible tether is anchored at 46 to the side guide rail 122 and extends to the opposite side for lap about free-running sprocket 47 to extend to connection at 48 with the piston rod end 227.

It will thus be understood that when the piston rod 27 is thrust to the left as viewed in FIGS. 3 and 4 the tether run 45 is slacked off back toward the far side 12 of the bed frame structure 10 to relieve the tension on the tether run 42 so as to permit the side guide rail 22 to move away from the side guide rail 122 for increasing the spacing therebetween. At the same time the piston rod end 127 is moved inward so as to apply pull to the tether run 29 for complementing the outward movement of the side guide rail 22, which, in turn, applies pull to the tether run 33 for moving the far side guide rail 122 outward in the opposite transverse direction with consequential pull on the tether run 37 which at 40 moves the near side guide rail 22 toward the bed frame structure side 11. These separations thus permit the first loaded cartons $C_1$ to be carried foward by the endless belt conveyor 23 to a forward position, such as that illustrated in FIG. 4. This now requires the provision of the secondary tolerance, which may be of the order of about one quarter of an inch (±0.25 inch).

The mechanism for providing such secondary tolerance is illustrated in detail in FIGS. 1 and 2 wherein the parts are illustrated in inoperative or initial positions of inactivity. A bracket 50 is anchored to the inside face of the bed frame structure sidewall 12, such as by screws 51. An axle bolt 52 extends through the bracket 50 for support thereby and, in turn, it pivotally supports an arm 53 that carries a head 54 in which is socketed for alternate inward and outward movement a toothed rack 55. Upon the opposite end 56 of the bolt axle 52 are rotatably supported coaxially a free-running gear 57 and the sprocket 43 about which the flexible chain tether 42 is lapped. The toothed rack 55 preferably is arcuate so that an appreciable number of teeth thereof will mesh accurately, as a latch, with the teeth of this gear 57, the latter being fixed for rotation with the sprocket 43. With this latch so engaged with the spur gear 57 swing of the latch will then rotate through a radial angle this gear and, simultaneously the sprocket 43 in a counterclockwise direction to translate the flexible tether run 42 in a direction to move the side guide rail 122 outward toward the bed frame structure sidewall 12 and, by the same token, move the other side guide rail 22 transversely away from it toward the opposite bed frame structure sidewall 11, to attain the additional secondary tolerance separation.

The socketed head 54 in which the latch rack 55 is reciprocatively mounted for alternate outward and inward movement, is supported upon one end 58 of a single-ended pneumatic motive cylinder 59 which has a projecting piston rod 60 (FIG. 2) that carries this latch rack. Remote from the head end 58 the single-ended cylinder 59 carries, such as at its opposite end 61, a bracket 62 to which is pivotally connected at 63 a fork 64 mounted upon the outer end of piston rod 65 of a second single-ended pneumatic motive cylinder 66, with a remote portion, such as the opposite back end 67 of this second pneumatic cylinder, pivotally supported by a bracket 68 at 69 to a fixed-location bracket 70 carried by the bed frame structure sidewall 12.

It will thus be understood that with the entry of the first loaded carton $C_1$ from the feeding conveyor 17 to between the side guide rails 22 and 122 the latter are moved inwardly toward the opposite sides of the carton by control mechanism such as in the manner taught in the above-identified prior art patents, but without any firm clamping action until the carton advances further to the stop station (to the right in the Figures and out of view therein) where such clamping action may be imposed in supplement to a stop paddle temporarily to hold each carton for having its top flaps folded down. Thus the width of this loaded carton will virtually be measured by the space therebetween while permitting sliding advance of such carton forward to such stop station. This adjustment of the relative positions of the side guide rails is effected by the operation of the double-ended pneumatic motive cylinder 25 and its runs of flexible tether in the manner described above. At this time the pair of single-ended pneumatic motive cylinders 59 and 66 are in their relatively inactive positions of FIGS. 1 and 2 with meshed engagement of the runs 33 and 42 of the flexible tether about the respective free running sprockets 34 and 43.

Upon the attainment of such initial measuring of the first loaded carton of the group of similar size that are to be fed successively from the feeding conveyor 17 into the automatic carton closing machine, between the transversely spaced side guide rails 22 and 122, control mechanism dictates feed of pressurized air through the supply conduit 161 (FIG. 2) to thrust the piston rod 60 of the first cylinder 59 forward for engagement of the latch 55 with the spur gear 57, as will be seen from FIG. 4. At this time, the second pneumatic cylinder 66 remains inactive. Now pressurized air is fed through the conduit 167 of this second cylinder to thrust its piston 65 forward so as to swing the first cylinder 59 laterally inward in a counterclockwise direction about the axis of the pivot bolt 52, as is also indicated in FIG. 4. As a result, the engaged latch 55 and its holder 54 cause the gear 57 to be rotated through a radial angle counterclockwise, so as to impose the same angular clockwise movement upon the sprocket 43 for additional longitudinal movement of the transverse runs of flexible tether to effect the small amount of additional tolerance spacing between the opposite sides of the carton $C_1$ and the inner sides of the side guide rails 122 and 22, as is illustrated at 75 in FIG. 5.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is the novel subjects matter defined in the following claims.

I claim:

1. In an automatic carton closing machine, adjustable holding mechanism for a pair of elongated longitudinal clamping rails which converts them to laterally spaced side guide rails extending through the machine to define a path of carton forward travel therebetween and provides sliding clearance for all loaded cartons of a group intended to be of about the same size while accommodating small degrees of variances in widths thereof, comprising 1. means to move at least one of said pair of side guide rails inward toward the other to cause them to be spaced apart with location thereof closely adjacent to opposite sides of a loaded carton of a single size group as it enters the machine for forward guided transport therebetween past flaps manipulating and anchoring mechanisms of the machine, and
2. means to adjust such spacing between said rails to assure a relatively small degree of additive tolerance which assures successive sliding accommodation of all of the cartons of this group including those which are of widths greater than the standard width.

2. The adjustable side guide rails and their operating mechanism of claim 1 characterized by said rail moving means being adapted simultaneously to moving said rails toward each other and alternatively apart with elastic application of driving force, said rail spacing adjusting means to provide the additive tolerance being adapted to force said rails farther apart to the additive tolerance distance positions and to maintain the same during the travel of the cartons of this group forward therebetween.

3. In an automatic carton closing machine, adjustable holding mechanism for a pair of elongated longitudinal clamping rails which converts them to laterally spaced side guide rails extending through the machine to define a path of carton forward travel therebetween and provides sliding clearance for all loaded cartons of a group intended to be of about the same size while accommodating small degrees of variances in widths thereof, comprising 1. elastic force applying means to move said rails toward each other and alternatively apart to the relatively spaced positions that allows the forward sliding transport with ease therebetween past the machine's flaps manipulating and anchoring mechanisms of the loaded cartons of the group which are of standard width, and 2. means further spacing apart said guide rails a relatively small additive tolerance distance which also allows the forward sliding transport with ease therebetween of the loaded cartons of this group which are of widths greater than the standard width.

4. The adjustable side guide rails and their operating mechanism of claim 3 characterized by said elastic force applying means including a gaseous medium cushion which permits some limited transverse movement of said guide rails relative to each other by additionally applied force.

5. The adjustable side guide rails and their operating mechanism of claim 4 characterized by said elastic force applying means and gaseous medium cushion including a pneumatic motor and drive transfer means operatively connecting said motor to said guide rails.

6. The adjustable side guide rails and their operating mechanism of claim 5 characterized by additional motive means connected to said drive transfer means additionally to translate the latter sufficiently to effect the further additive tolerance distance spacing of said guide rails.

7. The adjustable side guide rails and their operating mechanism of claim 6 characterized by said drive transfer means being in the form of a flexible pull tether which moves longitudinally between the penumatic motor and said guide rails with said tether being drivably connected to rotary means, said additional motive means being connectable to said rotary means for additional longitudinal translation of said tether to attain the further additive tolerance distance spacing.

8. The adjustable side guide rails and their operating mechanism of claim 7 characterized by said rotary means including spur gear means, said additional motive means including an arcuate rack engageable selectively with said spur gear means to rotate the latter through a radial angle upon arcuate movement of said rack when the latter is engaged with said gear.

9. The adjustable side guide rails and their operating mechanism of claim 8 chracterized by said additional motive means being in the form of fluid motive means alternately to engage and disengage said rack with said spur gear means and arcuately to swing said rack when engaged with said gear means.

10. The adjustable side guide rails and their operating mechanism of claim 9 characterized by said fluid motive means being in the form of a pair of single-ended pneumatic motive cylinders with a first one thereof pivotally mounted at one end about the axis of said spur gear means and having a piston rod extending therefrom with the latter carrying said rack, the other said single-ended motive cylinder having its cylinder pivotally supported at a substantially fixed remote point and a projecting piston rod which is pivotally connected to the cylinder of said first single-ended motive cylinder at a distance from said spur gear means axis for arcuate swing of this first single-ended motive cylinder.

* * * * *